US005291677A

United States Patent [19]

Samson et al.

[11] Patent Number: 5,291,677

[45] Date of Patent: Mar. 8, 1994

[54] ROTARY PHOTOGRAPH FILE

[76] Inventors: Gerald Samson; Mildreth Samson, both of 5701 W. Adams Blvd., Los Angeles, Calif. 90016

[21] Appl. No.: 808,149

[22] Filed: Dec. 16, 1991

[51] Int. Cl.[5] ..... G09F 11/00

[52] U.S. Cl. ..... 40/494; 40/530

[58] Field of Search ..... 40/494, 497, 500, 530, 40/119, 120, 530, 388, 389, 379, 377, 493; 402/26, 29, 32, 34

[56] References Cited

U.S. PATENT DOCUMENTS

| | | | |
|---|---|---|---|
| 805,575 | 11/1905 | Morden | 24/598.2 X |
| 841,706 | 1/1907 | Morden | 24/598.2 X |
| 2,514,068 | 7/1950 | Johnston | 40/530 X |
| 3,218,743 | 11/1965 | Shneider | 40/530 X |
| 3,791,059 | 2/1974 | Shneider | 24/598.2 X |
| 4,886,390 | 12/1989 | Silence et al. | 402/29 X |

FOREIGN PATENT DOCUMENTS

| | | | |
|---|---|---|---|
| 23072 | 2/1906 | Austria | 402/29 |
| 423109 | 4/1911 | France | 24/598.8 |

*Primary Examiner*—James R. Brittain
*Assistant Examiner*—C. Hope Davis
*Attorney, Agent, or Firm*—Albert M. Herzig

[57] ABSTRACT

A rotary file is disclosed herein for holding a plurality of photo holders slideably carried on a pair of spaced-apart rings between support members which are mounted on a base by a swivel mechanism. The rings include an extension arm securing each ring to a turning shaft having its opposite ends rotatable through the spaced support members. Each ring includes a space or gap between opposing end segments selectively opened and closed by a closure element such as a movable sleeve or the like. Each photo holder includes openings to receive the rings so as to be slideably carried thereon. Knobs mounted on opposite ends of the turning shaft permit manual rotation of the shaft about a horizontal axis while the photo holders are loosely held on the rings.

2 Claims, 2 Drawing Sheets

ROTARY PHOTOGRAPH FILE

BACKGROUND OF THE INVENTION

1. Field of the Invention

The present invention relates to the field of rotary files, and more particularly to a novel rotary file for movably supporting a group of picture holders for movement about a horizontal axis between support members carried by swivel means on a base.

2. Brief Description of the Prior Art

In the past, a number of rotary files have been employed for holding record cards or photo cards in such a manner that as a spindle is rotated, the plurality of cards will pass the view of the user so that the user may select an individual photo card for analysis or display. One such prior rotary card file is disclosed in U.S. Pat. No. 3,791,059. Problems and difficulties have been encountered with such a record holder, which stem largely from the fact that a closure means for occupying a gap in the ring is achieved by a spring mechanism which travels on a linear segment also used to support the ring on a turning axis. By such a means, the closure spring is difficult to reach and to operate due to the fact that it is completely captured on the linear segment of the ring and cannot be readily removed from the ring unless completely slid around the ring to a single end segment defining one end of the gap. Also, difficulties have been encountered because the spindle for holding the rings and the plurality of photo cards cannot be rotated or swiveled into a different orientation due to the fact that the plurality of photo cards are edge-mounted on the rings and the turning axis of the spindle is along a vertical axis.

Other problems relate to the fact that the plurality of photo cards are unevenly disposed by their side mountings onto the rings so that the outer sides or edges of the photo cards have a tendency to drop and engage with the base which action obstructs the turning of the cards by the user.

Therefore, a long-standing need has existed to provide a novel photo holder of the rotary type which eliminates the possibility of photo card engagement with its supporting structure and which provides an improved swivel arrangement permitting the user several axes of rotation in order to view the picture cards. Improvement is also needed in the area of ring gap closure so that such closure is convenient to the user and will not obstruct slideable movement of the picture cards.

SUMMARY OF THE INVENTION

In view of the foregoing, the above problems and difficulties are obviated by the present invention which provides a novel rotary picture holder for a plurality of picture cards or holders which employs a U-shaped frame having upright support members rotatably holding the opposite ends of a turning shaft. A pair of rings is mounted on the turning shaft between the support members by a fixed extension arm. Each ring includes a gap for accepting mounting holes in each of the respective card holders. The support members are mounted to a base by means of a swivel so that the plurality of cards may be moved by the user about a horizontal or a vertical axis at his selection.

Therefore, it is among the primary objects of the present invention to provide a novel photo holder having a pair of turning axes normal with respect to one another so that the user has a variety of card holder orientations in which to view the pictures on the photo holders.

Another object of the present invention is to provide a novel rotary photo holder for a plurality of pictures or the like which utilizes an improved closure means for closing the retaining gap on a pair of rings adapted for rotation about a horizontal and a vertical axis.

Another object of the present invention is to provide a novel photo holder having a rotatable support means for a plurality of holders so that the holders will not bind or engage with the support base as the holders are rotated.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
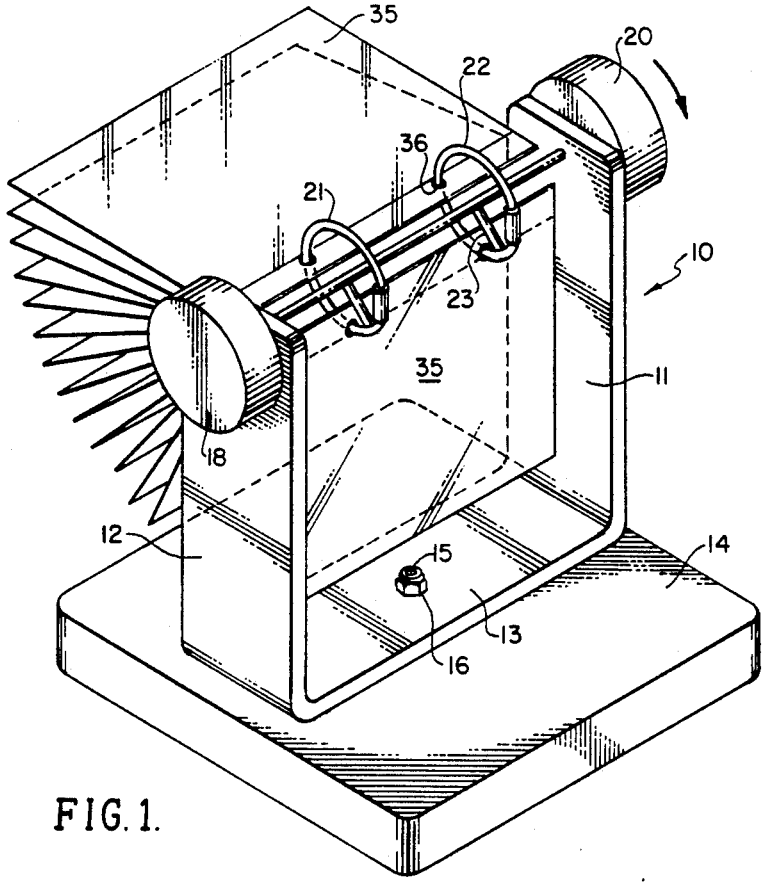
FIG. 1 is a front perspective view showing the novel photo holder of the present invention.

Referring to FIG. 1, the novel rotary photo display is indicated in the general direction of arrow 10, which includes a U-shaped bracket having a pair of spaced-apart upright support members identified by numerals 11 and 12, which are joined together by a cross-member 13. The cross-member 13 is carried on a square base 14 by means of a pivot bolt 15 and a lock nut 16. Numeral 32 in FIG. 2 illustrates nylon washers used with the pivot bolt so that the U-shaped bracket will pivot or swivel about a vertical axis with respect to the base 14.

Figure 2:
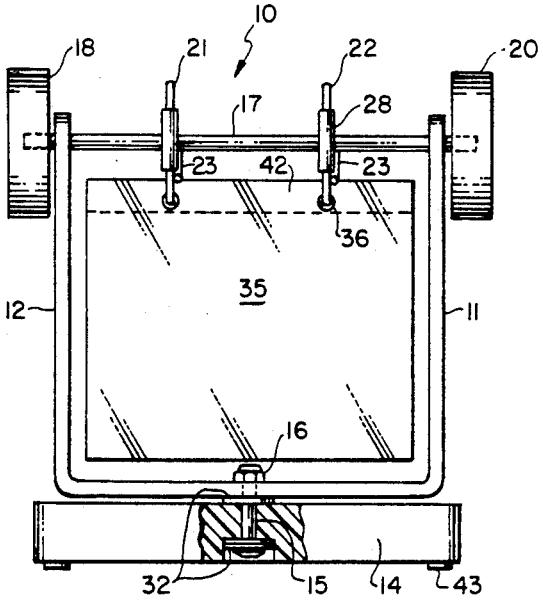
FIG. 2 is a front elevational view of the holder shown in FIG. 1.

FIGS. 1 and 2 further illustrate that the upper portion of the support members 11 and 12 rotatably mounts the opposite ends of a turning shaft 17 wherein the extreme opposite ends of the shaft outwardly project from the respective support members and are in threaded engagement with right and left turning knobs 18 and 20 respectively. Preferably, the U-shaped bracket, the base and the turning knobs are composed of a transparent or translucent material, such as Lucite or the like.

Figure 3:
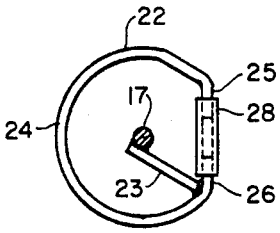
FIG. 3 is a cross-sectional view of the turning shaft showing the holding ring with the closure means closed.
Figure 4:
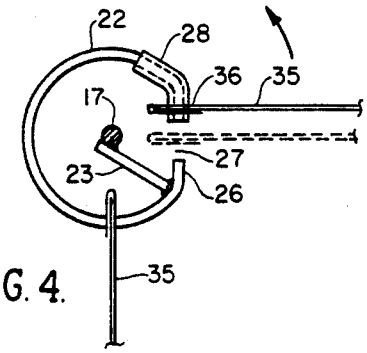
FIG. 4 is a view similar to the view of FIG. 3 illustrating the closure means open.

Referring now in detail to FIGS. 1 and 3, it can be seen that the turning axis 17 supports a pair of spaced-apart rings 21 and 22 by means of an interconnecting extension arm 23 associated with each of the rings. It is to be particularly noted that the rings 21 and 22 are not geometrically circular in side-elevational view and that each ring includes a curved semicircular portion 24 having terminating end segments 25 and 26 which are linear in length and include terminating ends which are coaxially disposed with respect to each other in opposing spaced-apart relationship so as to define a gap, broadly identified by numeral 27 in FIG. 4, inbetween. The gap 27 is selectively closed or opened by the user by means of a closure member 28 slideable between two positions. In FIG. 3, the closure member 28 takes the form of a tube or sleeve which is in its closed position having the end segments 25 and 26 within the open-ended bore of the sleeve 28. In FIG. 4, the sleeve closure member 28 is manually slipped over the end segment 25 to fully open the gap 27.

It is to be understood that the closure member 28 may take the form of a sleeve having an open-ended passageway whose opposite ends insertably receive the end segments 25 and 26. The sleeve may be provided with an elongated slit extending between its opposite ends in order to permit expansion when under pressure during the moving of the member between between the two positions shown in FIGS. 3 and 4. In another example, the ends of the sleeve closure member may be merely slit in order to provide ease of sleeve sliding along the linear end segments of the ring. Also, it may be preferred that the closure member material be composed of a chromium barrel and/or polytetrafluoroethytiene (Teflon) so that the sleeve may easily slide over the surface of the end segments. Such composition will provide a smooth and slick surface so that frictional contact will be readily overcome during the opening and closing procedure by the user. The sleeve-type closure member will not have a tendency to move out of its closed position when the rotary photo display is in use because of the slightly noncircular configuration of the one side of the ring 17.

Figure 6:
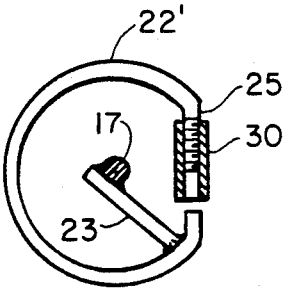
FIGS. 6, 7 and 8 are cross-sectional views of alternate closure means for closing the retaining gap on the respective rings.
Figure 7:
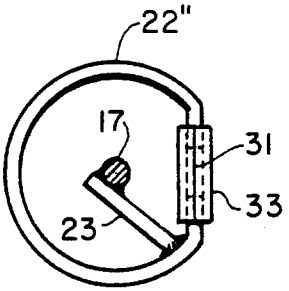
Figure 8:
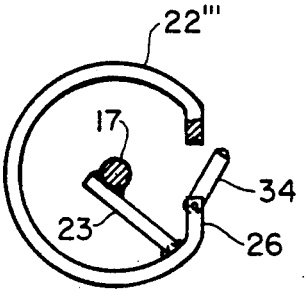

Different closure members are illustrated in FIGS. 6, 7 and 8 wherein FIG. 6 illustrates an internally threaded sleeve 30 which is rotatably carried on the threaded end of the linear segment 25 carried on a ring 22'. In FIG. 7, a closure member similar to the sleeve 28 is illustrated, which includes an elongated slit 31 extending between the opposite ends of a sleeve 33 so that binding of the sleeve is eliminated during the manual movement overcoming the frictional engagement of the sleeve with the end segments. In FIG. 8, another version of closure is illustrated by means of a pivoted member 34 carried on the end of end segment 26 on a ring 22'''.

FIGS. 1 and 2 illustrate that the rings 21 and 22 movably and slideably support a multiplicity of folder holders, such as holder 35. Each of the respective holders includes a pair of spaced-apart punched holes, as illustrated by numeral 36, which insertably receive the end segments of the respective rings 21 and 22 when the closure member is in its open position exposing the gap 27. This relationship is illustrated in FIG. 4 wherein the end of the holder 35 is positioned in the gap 27 when the closure member 28 exposes the gap so that the punched hole 36 can receive either segment 25 or 26 respectively. Preferably, the holes 36 are of a larger diameter than the diameter of the sleeve closure member 28 so that each of the holders 35 will slide over the external surface of the ring as well as the closure member itself. Therefore, as the turning knobs are grasped by the finger of the user and rotated so that the shaft 17 follows suit, the plurality of holders 35 will sequentially be exposed to the view of the user as the turning proceeds. When a particular photo in a selected holder has been reached, the user ceases rotation and the photo is available for viewing or, if desired, the closure members may be moved to open the gap for manual removal of the holder from the stack of holders. The user also has the option of rotating the multiplicity of holders about the vertical axis by pivoting of the U-shaped frame about the pivot bolt 15 on the base 14.

Figure 5:
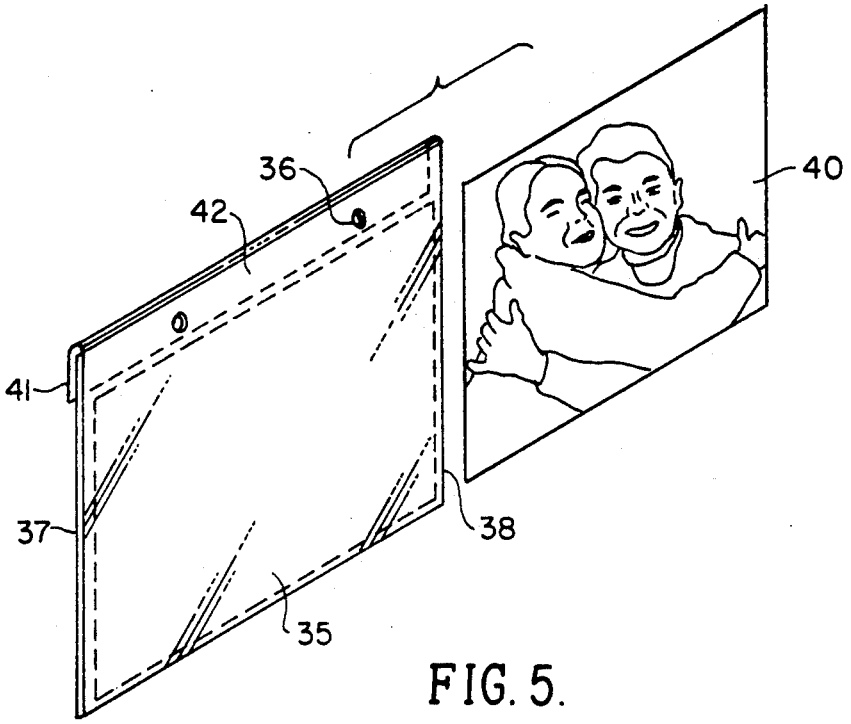
FIG. 5 is a front perspective view of a typical photo holder employed in the group shown in FIG. 1.

Referring now in detail to FIG. 5, the photo holder or envelope 35 is preferably composed of clear plastic sheet material wherein the opposite ends 37 and 38 provide a slotted opening through which a photograph 40 can be slid into position, as shown in dotted lines. In one form of holder, a single sheet of plastic material is folded over upon itself so as to provide the open sides or ends to permit the insertion or removal of the photo material. A portion of the sheet is folded over one end of the sheet so as to provide a double thickness for reinforcement purposes, and the holes 36 are punched through this double thickness. The end portion of the sheet is indicated by numeral 41 and the double thickness is indicated by numeral 42.

In view of the foregoing, it can be seen that the novel rotary photo display of the present invention provides a novel means by which a plurality of photographic material may be held in individual transparent holders or envelopes and that these holders may be movably held on the rings 21 and 22 so that revolving of the turning shaft 17 will sequentially and selectively expose individual photographic material in the respective holders. The plurality of holders may be rotated about the horizontal axis by means of knobs 18 or 20 and may be moved about a vertical axis by manual movement of the U-shaped frame carried on base 14 by the pivot or swivel bolt 15. The base 14 includes standoffs 43 located on the bottom of the base for supporting the display on a surface. Individual photo holders or envelopes may be added or removed from their location on the rings by means of the closure member which selectively opens and closes gap 27, permitting passage of the envelope therethrough.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A rotary photograph file comprising:

a base;

a U-shaped frame having a pair of spaced-apart support members joined by a cross-member;

swivel means pivotally connecting said U-shaped frame cross-member with said base for rotation of said frame about a vertical axis;

a turning shaft rotatably carried on said support members for rotation about a horizontal axis;

a plurality of holders disposed between said support members for rotation about a horizontal axis;

means operably joining said plurality of holders onto said turning shaft whereby said holders flip about said turning shaft as said shaft is rotated;

said joining means comprise a pair of rings fixedly secured to said turning shaft in spaced-apart relationship;

each ring of said pair having a gap defined between opposing ends of ring end segments and having an interconnecting arm connected at one end to said turn shaft and connected at the other end to said ring at a position spaced from one of said opposing ends of said ring end segments;

a closure member movably carried on said ring having a first position opening said gap and a second position closing said gap;

each of said holders includes a sheet of material folded over upon itself to provide an open-sided envelope adapted to insertably receive a graphic card through a selected one of said open sides;

said folded-over sheet providing a reinforced strip adjacent to said pair of rings;

said reinforcement strip having a pair of spaced-apart holes accepting said rings so as to be retained thereon;

said closure member is a sleeve having an open-ended passage extending between opposite ends of said sleeve to insertably receive said segment ends in slideable relationship;

said sleeve includes a longitudinal slit between said sleeve composed of a pliable material and opposite ends and being expandable to yieldably engage with said ring end segments.

2. The invention as defined in claim 1 wherein:

said U-shaped frame and said base are composed of a transparent material exposing said holders therethrough;

a knob carried on each end of said turning shaft separated from said rings by said support members; and said plurality of holders are aligned in a series on said rings with a defined clearance between said holder sides and said support members to avoid binding and interference when said turning shaft is rotated.

* * * * *